US008485637B2

(12) United States Patent
Dietl

(10) Patent No.: US 8,485,637 B2
(45) Date of Patent: Jul. 16, 2013

(54) CARRIAGE WITH CAPPING SURFACE FOR INKJET PRINTHEAD

(75) Inventor: Steven J. Dietl, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 113 days.

(21) Appl. No.: 13/014,763

(22) Filed: Jan. 27, 2011

(65) Prior Publication Data

US 2012/0194612 A1 Aug. 2, 2012

(51) Int. Cl.
*B41J 23/00* (2006.01)
*B41J 2/165* (2006.01)
*B21D 53/76* (2006.01)

(52) U.S. Cl.
USPC ..... 347/37; 29/890.1; 347/29

(58) Field of Classification Search
USPC ..... 347/37
See application file for complete search history.

(56) References Cited

U.S. PATENT DOCUMENTS

| | | | | |
|---|---|---|---|---|
| 4,500,895 | A | 2/1985 | Buck et al. | |
| 5,027,134 | A | 6/1991 | Harmon et al. | |
| 5,751,324 | A | 5/1998 | Brandon et al. | |
| 6,244,683 | B1 * | 6/2001 | Alvarez et al. | 347/22 |
| 6,305,786 | B1 * | 10/2001 | Plotkin et al. | 347/50 |
| 6,722,756 | B2 * | 4/2004 | Choy et al. | 347/29 |
| 6,902,260 | B2 * | 6/2005 | Aschoff et al. | 347/63 |
| 7,018,503 | B2 | 3/2006 | Murthy et al. | |
| 7,862,147 | B2 | 1/2011 | Ciminelli et al. | |
| 2007/0195122 | A1 * | 8/2007 | Hiruma et al. | 347/29 |
| 2008/0149024 | A1 * | 6/2008 | Petruchik et al. | 118/300 |
| 2009/0079097 | A1 * | 3/2009 | Williams et al. | 257/787 |
| 2009/0179963 | A1 * | 7/2009 | Karppinen et al. | 347/47 |

FOREIGN PATENT DOCUMENTS

| | | |
|---|---|---|
| EP | 0867297 | 9/1998 |
| WO | 2009/145792 | 12/2009 |

* cited by examiner

*Primary Examiner* — Matthew Luu
*Assistant Examiner* — Alexander D Shenderov
(74) *Attorney, Agent, or Firm* — Peyton C. Watkins

(57) ABSTRACT

A carriage for conveying an inkjet printhead in a printer, the carriage including a holding receptacle for the inkjet printhead, the holding receptacle includes a first sidewall; a second sidewall opposite the first sidewall; and a bottom wall extending between the first sidewall and the second sidewall, the bottom wall including a frame surrounding an opening, wherein the frame is configured to be sealingly engageable with a face of the printhead.

20 Claims, 10 Drawing Sheets

CARRIAGE WITH CAPPING SURFACE FOR INKJET PRINTHEAD

FIELD OF THE INVENTION

The present invention relates generally to a carriage for an inkjet printer, and more particularly to a capping surface provided for a printhead held in the carriage.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead is moved by the carriage in a carriage scan direction that is substantially perpendicular to the media advance direction as the drops are ejected from the nozzles. After the printhead has printed a swath of the image while traversing the recording medium, the recording medium is advanced, the carriage direction of motion is reversed, and the image is formed swath by swath.

In an inkjet printer, the face of the printhead die containing the nozzle array(s) is typically positioned near the recording medium in order to provide improved print quality. Close positioning of the nozzle face of the printhead die to the recording medium keeps the printed dots close to their intended locations, even for angularly misdirected jets.

In order to provide the capability of printing across the entire width of the recording medium, and also to allow space for the carriage to decelerate and stop before changing directions to print the next swath, typically the carriage moves the printhead beyond the side edges of the recording medium. Generally the position of the recording medium relative to the printhead die face is fairly well controlled. However, occasionally a sheet of recording medium can have a dog-eared edge. Also occasionally multiple sheets of recording medium can be inadvertently fed at the same time, sometimes resulting in paper jamming and folding in accordion fashion. In such situations, the close proximity of the printhead die face to the nominal position of the recording medium can result in recording medium striking the face of the die as the carriage moves the printhead past the edge of the recording medium. For die faces made of material that is fragile or brittle, such strikes can cause catastrophic damage to the printhead, requiring its replacement. Commonly assigned U.S. Pat. No. 7,862,147 discloses providing inclined surfaces near the printhead die to protect the nozzle face from damaging impact by recording medium. Several patents including U.S. Pat. Nos. 7,018,503, 6,902,260, 5,751,324, and 4,500,895 disclose mounting the printhead die within a recess in the mounting substrate. Such a recess at the mounting substrate can help protect the die, but can add manufacturing complexities.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if evaporation of volatile components in the vicinity of the nozzle causes the viscosity to increase too much. The maintenance station of the printer typically includes a cap that surrounds the printhead die nozzle face during periods of nonprinting in order to inhibit evaporation of the volatile components of the ink, and also to provide protection against accumulation of particulates on the nozzle face. The capping surface that the maintenance station cap seats against is conventionally provided on the face of the printhead. Such a capping surface on the printhead face is exposed at an opening in the printhead holding receptacle of the carriage. This can present multiple discontinuous interfaces along the carriage scan direction, including the carriage edges at the opening, the capping surface on the printhead face, the inclined surfaces (as in U.S. Pat. No. 7,862,147) and the printhead die. Such discontinuous interfaces can collect ink residue and can catch an edge of the recording medium.

What is needed is a printhead carriage that provides a substantially smooth surface of the portion of the printhead carriage assembly that is close to the recording medium along the carriage scan direction, provides protection for the printhead die, and provides a capping surface and seal for the maintenance station cap to inhibit evaporation of volatile ink components.

SUMMARY OF THE INVENTION

The present invention is directed to overcoming one or more of the problems set forth above. Briefly summarized, according to one aspect of the invention, the invention resides in a carriage for conveying an inkjet printhead in a printer, the carriage including a holding receptacle for the inkjet printhead, the holding receptacle includes a first sidewall; a second sidewall opposite the first sidewall; and a bottom wall extending between the first sidewall and the second sidewall, the bottom wall including a frame surrounding an opening, wherein the frame is configured to be sealingly engageable with a face of the printhead.

DETAILED DESCRIPTION OF THE INVENTION

Figure 1:
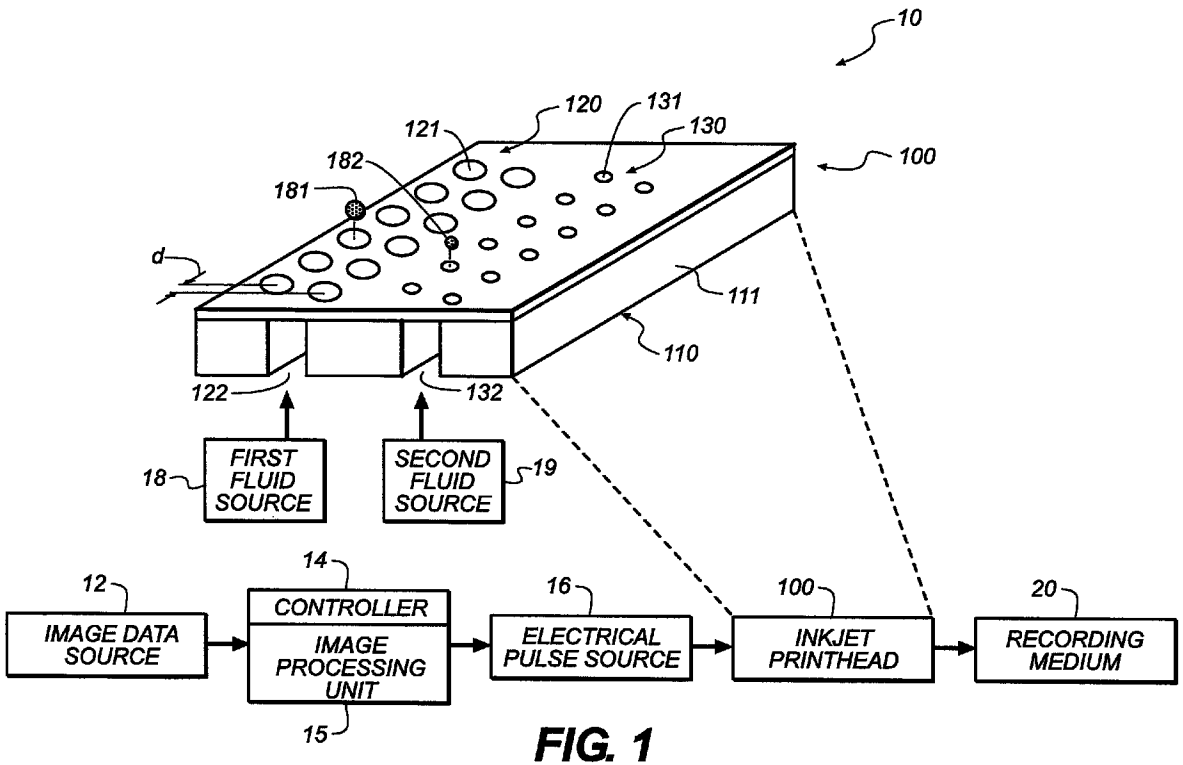
FIG. 1 is a schematic representation of an inkjet printer system.

Referring to FIG. 1, a schematic representation of an inkjet printer system 10 is shown for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays disposed at a surface of inkjet printhead die 110. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
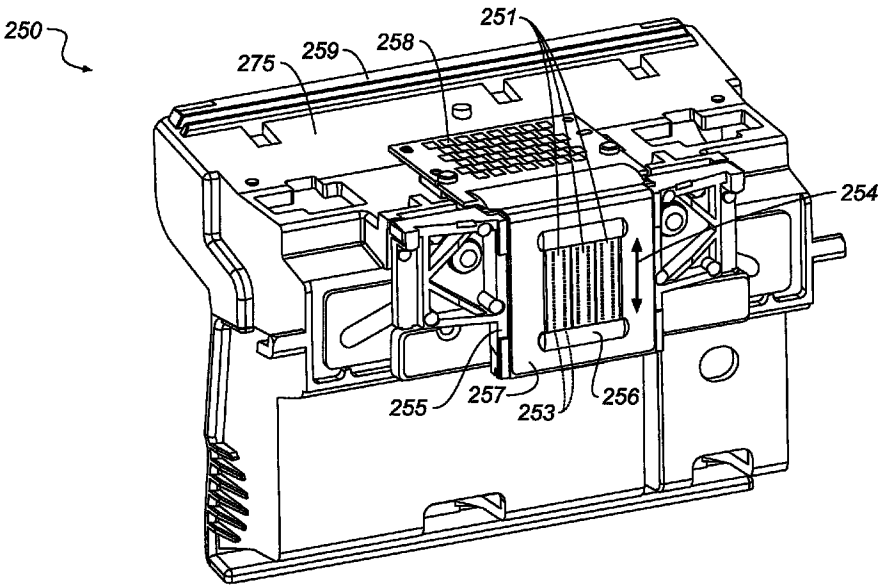
FIG. 2 is a perspective view of a portion of a printhead.

FIG. 2 shows a perspective view of a portion of a printhead 250, which is an example of an inkjet printhead 100. Printhead 250 includes three printhead die 251 (similar to printhead die 110 in FIG. 1) that are affixed to mounting substrate 255. The surface of the mounting substrate 255 to which the printhead die 250 are bonded is also called a face 252 of the printhead (see FIG. 10). Each printhead die 251 contains two nozzle arrays 253, so that printhead 250 contains six nozzle arrays 253 altogether. The six nozzle arrays 253 in this example are each to be connected to ink sources (not shown in FIG. 2), such as cyan, magenta, yellow, text black, photo black, and protective fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flexible circuit 257 to which the printhead die 251 are electrically interconnected, for example, by wire bonding or TAB bonding. Flexible circuit 257 is also adhered to mounting substrate 255, and surrounds the printhead die 250. The interconnections are covered by an encapsulant 256 to protect them. Flexible circuit 257 bends around the side of printhead 250 and connects to connector board 258 on rear wall 275. An edge 259 on rear wall 275 serves as a catch for latching printhead 250 into carriage 200 at latch 249. See FIGS. 5 and 7. When printhead 250 is mounted into the carriage 200, connector board 258 is electrically connected to a connector 244 on the carriage 200, so that electrical signals can be transmitted to the printhead die 251.

Figure 3:
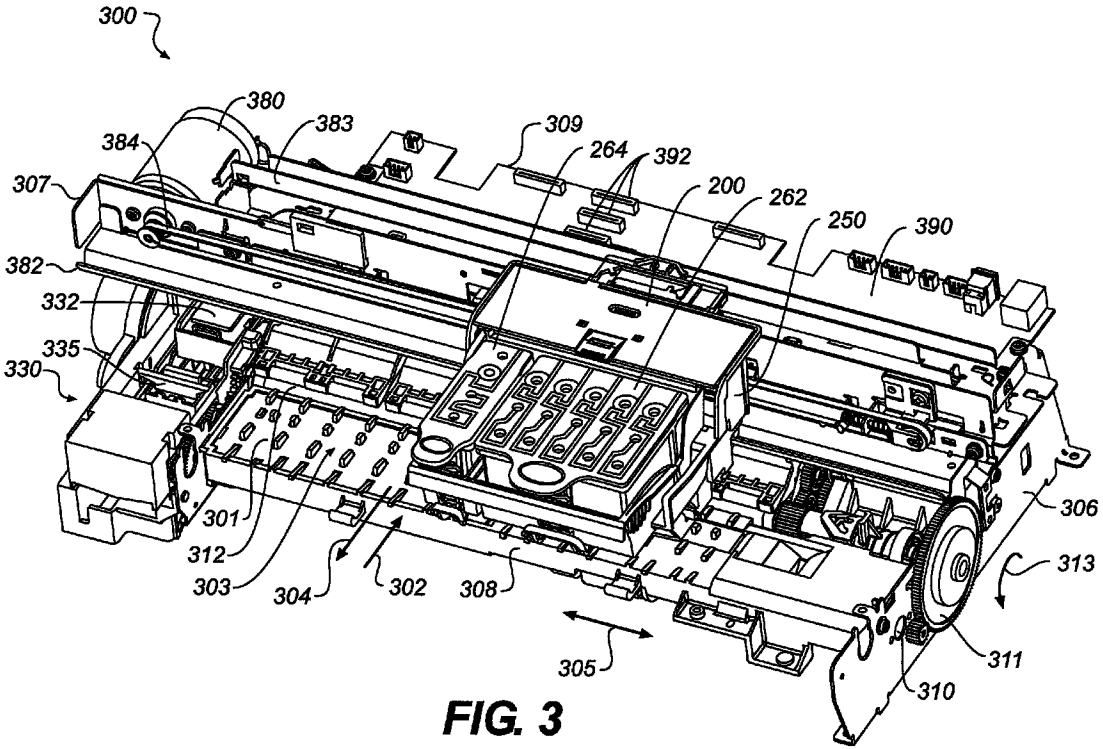
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a platen 301 in print region 303 across which carriage 200 is moved back and forth in carriage scan direction 305 between the right side 306 and the left side 307 of printer chassis 300, while drops are ejected from printhead die 251 (not shown in FIG. 3) on printhead 250 that is mounted on carriage 200. Paper or other recording medium is held substantially flat against platen 301, although sometimes an edge of the recording medium lifts away from platen 301. Carriage motor 380 moves belt 384 to move carriage 200 along carriage guide rail 382. An encoder sensor (not shown) is mounted on carriage 200 and indicates carriage location relative to an encoder fence 383.

The mounting orientation of printhead 250 is rotated relative to the view in FIG. 2 so that the printhead die 251 are located at the bottom side of printhead 250, the droplets of ink being ejected downward onto the recording medium in print region 303 in the view of FIG. 3. Multi-chamber ink tank 262, in this example, contains five ink sources: cyan, magenta, yellow, photo black and colorless protective fluid; while single-chamber ink tank 264 contains the ink source for text black. Ink tanks 262 and 264 can include electrical contacts (not shown) for data storage devices, for example, to track ink usage. In other arrangements, rather than having a multichamber ink tank to hold several ink sources, all ink sources are held in individual single chamber ink tanks. Paper or other recording medium (sometimes generically referred to as paper or media herein) is loaded along paper load entry direction 302 toward the front of printer chassis 308.

Figure 4:
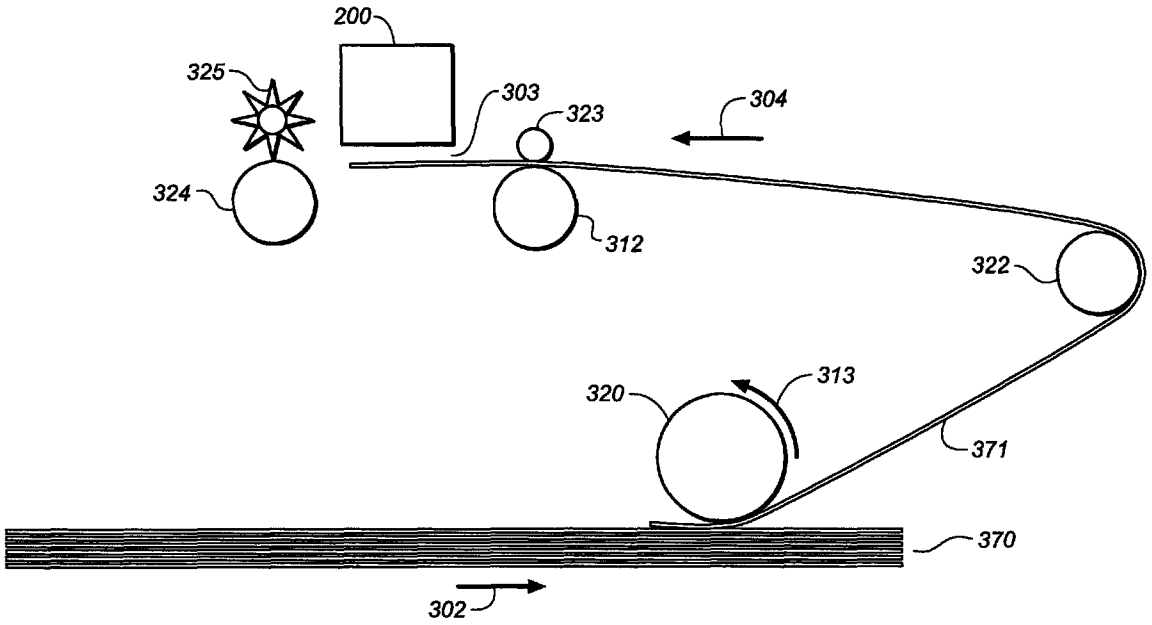
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance across print region 303 (platen not shown), and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330 including a cap 332 and a wiper (not shown).

Toward the rear of the printer chassis 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
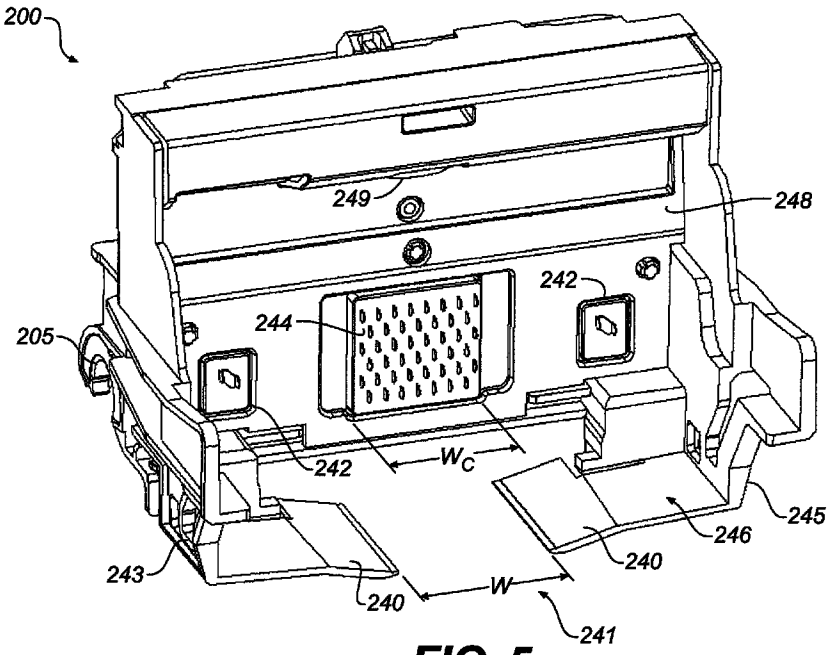
FIG. 5 (PRIOR ART)
FIG. 5 is a perspective view of a prior art carriage.
Figure 6:
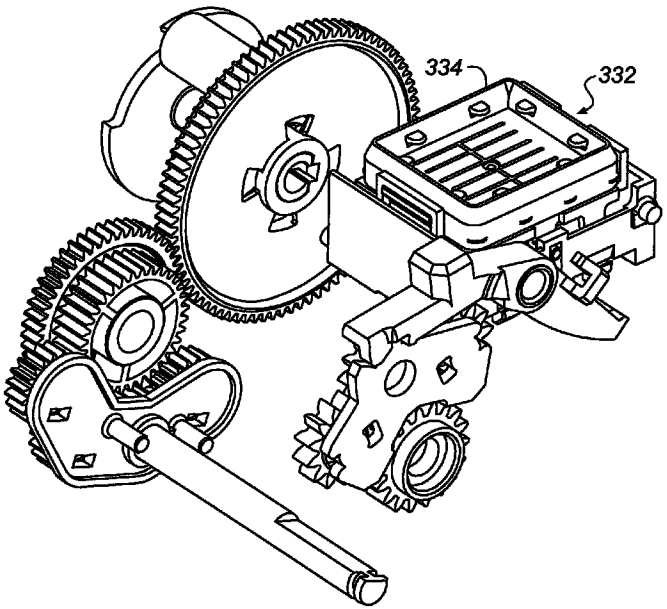
FIG. 6 is a close-up view of a cap of a maintenance station.

FIG. 5 shows a prior art carriage 200. With reference also to FIG. 2, holding receptacle 246 of carriage 200 receives a printhead 250. Printhead electrical connector 244 on rear wall 248 of carriage 200 mates with connector board 258 when the printhead is installed in the carriage. Electrical contacts (not shown) on multichamber ink tank 262 and single chamber ink tank 264 mate with electrical connectors 242 in carriage 200 when the printhead and ink tanks are properly installed. Printhead die 251 and flexible circuit 257 are exposed through the gap 241 between flaps 240 of carriage 200. Flaps 240 extend inwardly from first sidewall 243 and second sidewall 245. Gap 241 between the ends of the two flaps 240 has a width W that is about the same or a bit larger than width $W_C$ along a direction between the first sidewall 243 and the second sidewall 245. This is because the connector width $W_C$ and the gap width W are about the same width as the flexible circuit 257. In this arrangement the surface of flexible circuit 257 surrounding printhead die 251 becomes the capping surface against which elastomeric rim 334 of cap 332 seals. A close-up view of cap 332 and elastomeric rim 334 is shown in FIG. 6 together with gears for operating a peristaltic suction pump to provide suction at the cap for priming the printhead nozzles when needed. Carriage 200 also includes carriage bushing 205 for riding along carriage guide rail 382 in printer 300 (see FIG. 3).

Figure 7:
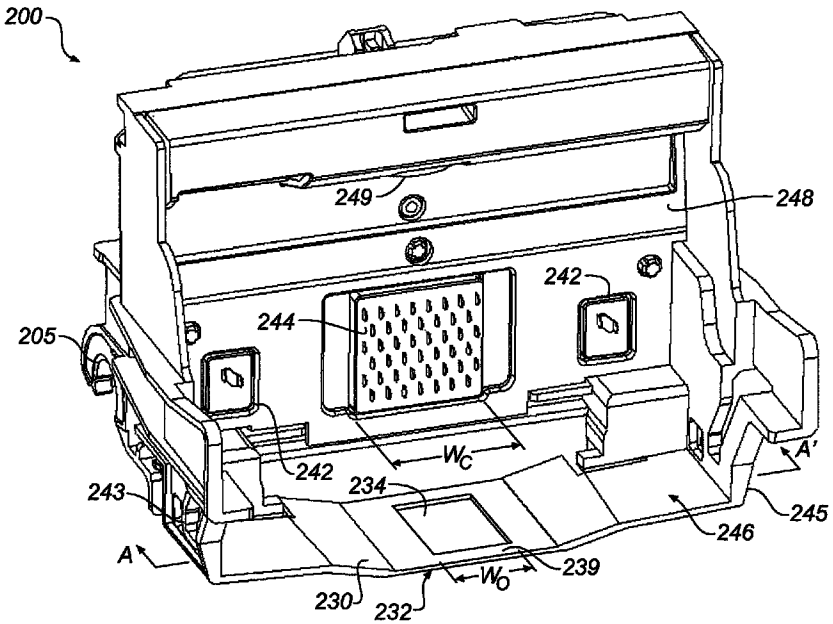
FIG. 7 is a perspective view of a carriage according to an embodiment of the invention.
Figure 8:
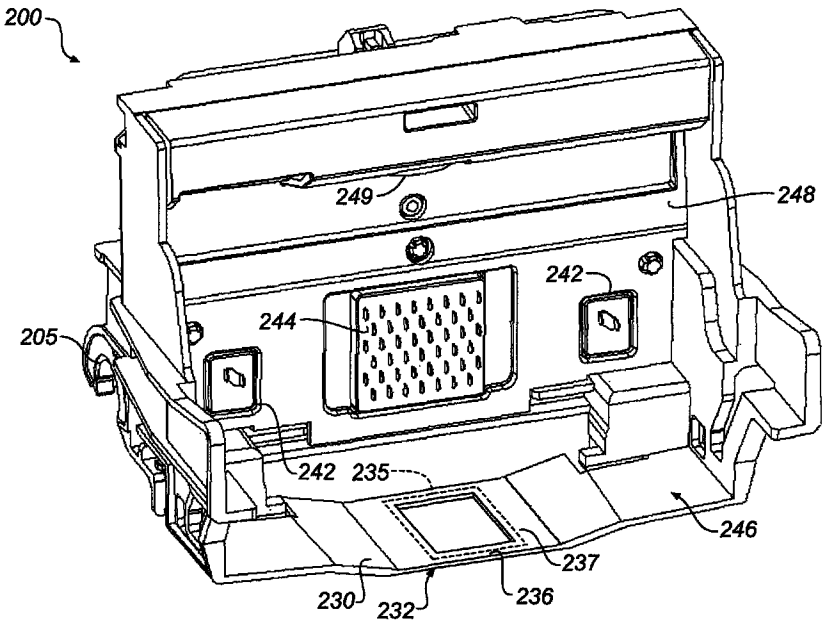
FIG. 8 is the carriage of FIG. 7, also indicating the location of a seal.
Figure 9:
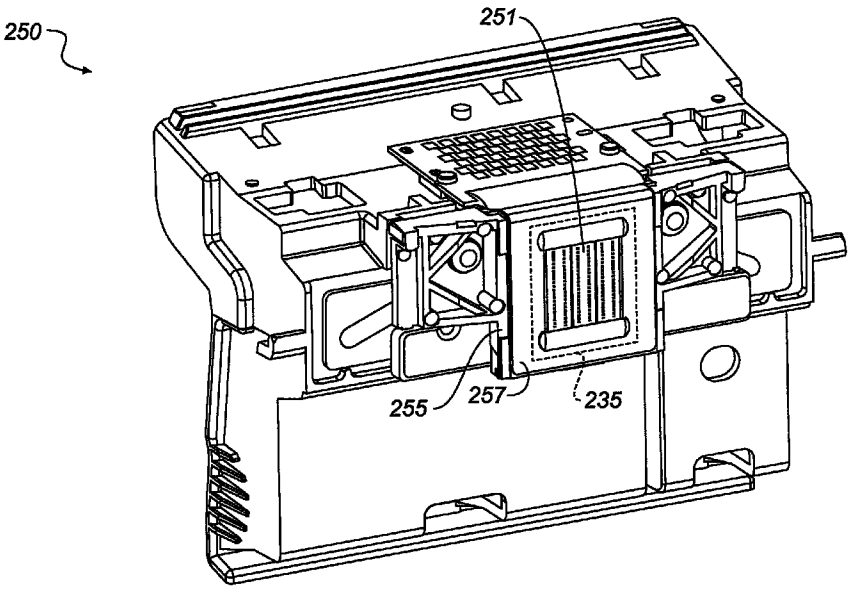
FIG. 9 is the printhead of FIG. 2, also indicating the location of a seal.

FIG. 7 shows a carriage 200 according to an embodiment of the invention. A primary change relative to the prior art carriage of FIG. 5 is that rather than having two flaps 240 extending inwardly from first sidewall 243 and second sidewall 245 and separated by a gap 241, instead a bottom wall 230 extends between first sidewall 243 and second sidewall 245. Holding receptacle 246 for printhead 250 includes rear wall 248, first sidewall 243 extending from rear wall 248, second sidewall 245 opposite first sidewall 243, and bottom wall 230 in this example. Bottom wall 230 includes a frame 232 surrounding an opening 234. Another way to describe the difference between the prior art of FIG. 5 and the embodiment in FIG. 7 is that the region of bottom wall 230 corresponding to the flaps 240 of FIG. 5 has been extended and connected by cross pieces 239 on opposite sides of opening 234. For a similar sized printhead 250 that would fit into prior art carriage 200 of FIG. 5, width $W_O$ of opening 234 is smaller than width W of gap 241 along a direction between the first sidewall 243 and the second sidewall 245, because in the embodiment of FIG. 7, frame 232 is configured to cover most or all of flexible circuit 257 on the printhead face rather than exposing flexible circuit 257. As a result, the width $W_C$ of electrical connector 244 is typically greater than width $W_O$ of opening 234 surrounded by frame 232. Rather than the capping surface being provided by flexible circuit 257, capping surface is instead provided by frame 232 of bottom wall 230 of carriage 200. With reference to FIGS. 6 and 8, in order to provide a complete seal around the printhead die 251 when the elastomeric rim 334 of cap 332 of maintenance station is pressed against the outer side 236 of frame 230, it is also necessary for the inner side 237 of frame 232 to be sealingly engageable with the face of the printhead (or, equivalently, with the flexible circuit that is attached to the face of the printhead). A sealing material can be provided at the seal location 235 indicated by the dashed line on the inner side 237 of frame 232 in FIG. 8 and on the flexible circuit 257 around the printhead die in FIG. 9. For printheads that are removably installable into the carriage, the sealing material at seal location 235 can be an elastomeric gasket seal that is affixed to either the flexible circuit 257 or to the inner side 237 of frame 232. For arrangements where the printhead is permanently attached to the carriage, the sealing material can be an adhesive seal.

Figure 10:
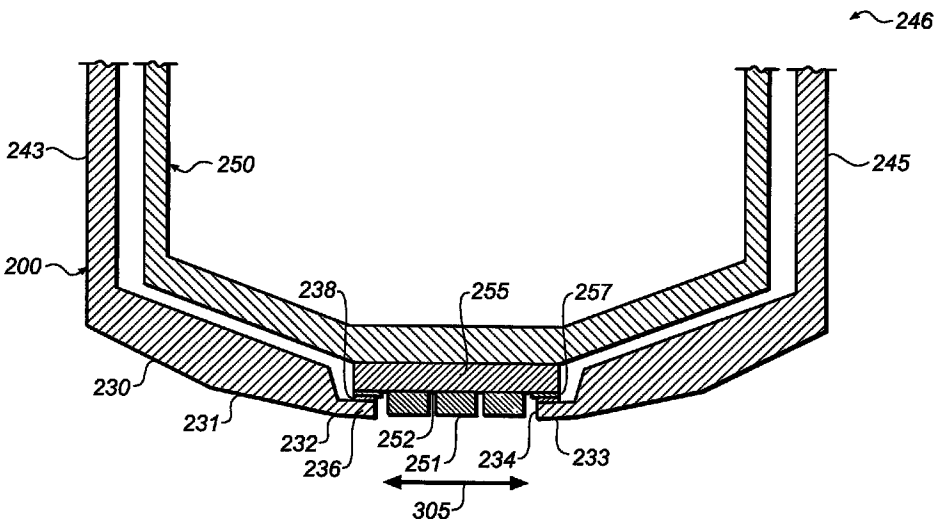
FIG. 10 is a cross-sectional view of a portion of the carriage of FIG. 7, along A-A' with printhead installed.

FIG. 10 is a cross-sectional view (along A-A' of FIG. 7) in a region around bottom wall 230 of a carriage 200 with printhead 250 installed in holding receptacle 246. The printhead 250 installed in carriage 200 is collectively called an inkjet printhead carriage assembly. The orientation of the printhead 250 is with the three printhead die 250 facing downward as they would in the printer. Frame 232 in this example includes a lip 233 having a smaller thickness relative to parts of bottom wall 230 nearer to sidewalls 243 and 245. Lip 233 extends over the flexible circuit 257. Seal 238 (either elastomeric or adhesive seal) is provided between lip 233 and flexible circuit 257 and surrounds the three printhead die 251 that protrude into opening 234 (see also FIGS. 8 and 9). Seal 238 can also be said to be disposed between the face 252 of printhead 250 and frame 232 (at lip 233). Particularly for an elastomeric seal and a removable printhead 250, when printhead 250 is installed in holding receptacle 246 and latched in place by latch 249 (FIG. 8) printhead 250 is biased downward toward bottom wall 230 of carriage 240, thereby compressing seal 238. In some embodiments, bottom wall 230 is deflectable so that the frame 232 is in a first position (deflected downward) when the printhead is installed and in a second position when the printhead is not installed. When bottom wall 230 is in its deflected state it provides spring force upward toward seal 238. In such embodiments, the carriage 200 can be fabricated (e.g. by injection molding) such that cross pieces 239 (FIG. 7) of frame 232 arch upward somewhat in the undeflected state, in order to facilitate the downward deflection when the printhead 250 is installed. It can be said that bottom wall 230 is configured to provide a compressive force on the seal when the printhead is installed. Seal 238 is configured to provide a substantially air-tight enclosure around the printhead die 250 when the printhead is parked at maintenance station 330 and rim 334 of cap 332 is in contact with the outer side 236 of frame 232. In this way evaporation of nonvolatile components of the ink is inhibited while the printhead is not being used for printing, and vacuum suction applied through the cap is effective for priming of the nozzles.

A further feature of bottom wall 230 of carriage 200 illustrated in FIG. 10 is that a portion 231 located near frame 232 is sloped downward on both sides of the frame. The downward sloping of the bottom wall 230, as well as the lip 233 extending over the flexible circuit 257, provide a substantially smooth surface along carriage scan direction 305. Even if an edge of recording medium lifts away from platen 301 (FIG. 3), sloped bottom wall 230 tends to deflect it back, and lip 233 tends to keep a lifted portion of recording medium away from the nozzle faces (i.e. the die surfaces) of printhead die 251. In the example shown in FIG. 10, printhead die 250 protrude into opening 234, but are recessed slightly relative to the outer surface of lip 233 of frame 232 to provide further protection for the nozzle faces. The wiper of maintenance station 330 typically wipes across both the outer side 236 of lip 233 and the nozzle face of printhead die 251, so the printhead die are typically recessed by on the order of 0.1 mm to allow the elastomeric wiper to conform to both surfaces.

In summary, the present invention includes a carriage for conveying an inkjet printhead in a printer, the carriage including a holding receptacle for the inkjet printhead, the holding receptacle comprising: a first sidewall; a second sidewall opposite the first sidewall; and a bottom wall extending between the first sidewall and the second sidewall, the bottom wall including a frame surrounding an opening, wherein the frame is configured to be sealingly engageable with a face of the printhead.

Advantages of the invention include (but may not be limited to) the following: a) a substantially smooth surface of the portion of the printhead carriage assembly that is close to the recording medium along the carriage scan direction; b) protection for the printhead die; and c) a capping surface and seal for the maintenance station cap to inhibit evaporation of volatile ink components.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First ink source
19 Second ink source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
205 Carriage bushing
230 Bottom wall
231 Portion (of bottom wall)
232 Frame
233 Lip
234 Opening
235 Seal location
236 Outer side (of frame)
237 Inner side (of frame)
238 Seal
239 Cross piece
240 Flaps (prior art)
241 Gap (prior art)
242 Electrical connector
243 First sidewall
244 Printhead electrical connector
245 Second sidewall
246 Holding receptacle (for printhead)
248 Rear wall
249 Latch
250 Printhead
251 Printhead die
252 Printhead face
253 Nozzle array
254 Nozzle array direction
255 Mounting substrate
256 Encapsulant
257 Flexible circuit
258 Connector board
259 Edge
262 Multichamber ink tank
264 Single chamber ink tank
275 Rear wall (of printhead)
300 Printer chassis
301 Platen
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
332 Cap
334 Rim (of cap)
370 Stack of media

371 Top piece of medium
380 Carriage motor
382 Carriage guide rail
383 Encoder fence
384 Belt
390 Printer electronics board
392 Cable connectors

The invention claimed is:

1. A carriage for conveying an inkjet printhead in a printer, the carriage including a holding receptacle for the inkjet printhead, the holding receptacle comprising:
a first sidewall;
a second sidewall opposite the first sidewall; and
a bottom wall extending between the first sidewall and the second sidewall, the bottom wall including a frame surrounding an opening, wherein the frame includes a lip having a smooth or substantially smooth outer surface along a carriage scan direction to which outer surface a printhead die is recessed when installed, and the lip is configured to be sealingly engageable with a flexible circuit of the printhead in order to form a substantially air-tight seal around at least one printhead die bonded to a printhead face and to provide protection for nozzle faces.

2. The carriage of claim 1, the bottom wall including a first thickness near the sidewalls and a second thickness near the opening surrounded by the frame, wherein the first thickness is greater than the second thickness.

3. The carriage of claim 1 further comprising an electrical connector including a width along a direction between the first sidewall and the second sidewall, wherein the width of the electrical connector is greater than a width of the opening along the direction between the first sidewall and the second sidewall.

4. The carriage of claim 1, wherein a portion of the bottom wall is sloped.

5. The carriage of claim 1, wherein the bottom wall is deflectable so that the frame is in a first position when the printhead is installed and in a second position when the printhead is not installed.

6. An inkjet printhead carriage assembly comprising:
an inkjet printhead including:
a printhead face;
a flexible circuit affixed to the printhead face; and
at least one printhead die affixed to the printhead face, the at least one printhead die including at least one nozzle array disposed at a nozzle face;
a carriage including a holding receptacle for the inkjet printhead, the holding receptacle including:
a first sidewall;
a second sidewall opposite the first sidewall; and
a bottom wall extending between the first sidewall and the second sidewall, the bottom wall including a frame surrounding an opening; wherein the frame includes a lip having a smooth or substantially smooth outer surface along a carriage scan direction to which outer surface the printhead die is recessed when installed, and the lip is configured to be sealingly engageable with the flexible circuit of the printhead in order to form a substantially air-tight seal around the at least one printhead die bonded to the printhead face and to provide protection for the nozzle face; and
a seal disposed in contact with both the flexible circuit and the frame of the bottom wall of the carriage.

7. The inkjet printhead carriage assembly of claim 6, the frame of the bottom wall of the carriage including a lip proximate the opening, wherein the seal is disposed between the face of the inkjet printhead and the lip of the frame.

8. The inkjet printhead carriage assembly of claim 6, wherein the seal is an elastomeric seal.

9. The inkjet printhead carriage assembly of claim 6, wherein the seal is an adhesive seal.

10. The inkjet printhead carriage assembly of claim 6, wherein the bottom wall of the carriage is configured to provide a compressive force on the seal between the frame and the face of the inkjet printhead.

11. The inkjet printhead carriage assembly of claim 6, wherein the at least one printhead die protrudes into the opening surrounded by the frame of the bottom wall of the carriage.

12. The inkjet printhead carriage assembly of claim 11, wherein the die surface of the at least one printhead die is recessed relative to an outer portion of the frame of the carriage.

13. An inkjet printer comprising:
a media advance system for advancing print media along a media advance direction;
an inkjet printhead carriage assembly comprising:
an inkjet printhead including:
a printhead face;
a flexible circuit affixed to the printhead face; and
at least one printhead die affixed to the printhead face, the at least one printhead die including at least one nozzle array disposed at a nozzle face;
a carriage for conveying the inkjet printhead along a print zone, the carriage including a holding receptacle for the inkjet printhead, the holding receptacle including a frame around an opening into which the at least one printhead die protrudes; wherein the frame includes a lip having a smooth or substantially smooth outer surface along a carriage scan direction to which outer surface the printhead die is recessed when installed, and the lip is configured to be sealingly engageable with the printhead face in order to form a substantially air-tight seal around at least one printhead die bonded to the printhead face and to provide protection for the nozzle face; and
a seal disposed in contact with both the flexible circuit and the frame disposed around the opening; and
a maintenance station including a cap.

14. The inkjet printer of claim 13, wherein the cap is configured to contact the frame of the carriage when the inkjet printhead is parked at the maintenance station.

15. The inkjet printer of claim 14, wherein the seal disposed between the face of the inkjet printhead and the frame of the carriage is configured to provide a substantially air-tight enclosure around the at least one printhead die when the cap is in contact with the frame of the carriage.

16. The inkjet printer of claim 13, wherein the die surface of the at least one printhead die is recessed relative to an outer portion of the frame of the carriage.

17. The inkjet printer of claim 13, the carriage further including:
a rear wall;
a first sidewall extending from the rear wall;
a second sidewall opposite the first sidewall; and
a bottom wall extending between the first sidewall and the second sidewall, the bottom wall including the frame surrounding the opening, wherein a portion of the bottom wall is sloped.

18. The inkjet printer of claim 17, the media advance system including a platen to support media in the print zone, wherein the bottom wall of the carriage is configured to deflect edges of media that are raised relative to the platen away from the die surface of the at least one printhead die.

19. The inkjet printer of claim 13, wherein the seal is an elastomeric seal.

20. The inkjet printer of claim 13, wherein the seal is an adhesive seal.

* * * * *